US010502379B2

(12) United States Patent
Kono et al.

(10) Patent No.: US 10,502,379 B2
(45) Date of Patent: Dec. 10, 2019

(54) VEHICLE LIGHTING FIXTURE

(71) Applicant: Stanley Electric Co., Ltd., Tokyo (JP)

(72) Inventors: Katsuhiko Kono, Tokyo (JP); Shinji Yamagata, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 712 days.

(21) Appl. No.: 15/077,286

(22) Filed: Mar. 22, 2016

(65) Prior Publication Data

US 2016/0281953 A1 Sep. 29, 2016

(30) Foreign Application Priority Data

Mar. 24, 2015 (JP) ..... 2015-060584

(51) Int. Cl.

| | |
|---|---|
| ***F21S 41/147*** | (2018.01) |
| ***F21S 41/36*** | (2018.01) |
| ***F21S 41/365*** | (2018.01) |
| ***F21S 41/689*** | (2018.01) |
| *F21S 41/255* | (2018.01) |

(52) U.S. Cl.

CPC ..... *F21S 41/147* (2018.01); *F21S 41/36* (2018.01); *F21S 41/689* (2018.01); *F21S 41/255* (2018.01); *F21S 41/365* (2018.01)

(58) Field of Classification Search

CPC ..... F21S 41/147; F21S 41/36; F21S 41/689
See application file for complete search history.

(56) References Cited

U.S. PATENT DOCUMENTS

| | | | | |
|---|---|---|---|---|
| 8,297,814 | B2 * | 10/2012 | Tanaka | F21S 41/689 362/539 |
| 2005/0259431 | A1 * | 11/2005 | Iwasaki | F21S 48/1159 362/514 |
| 2006/0098450 | A1 * | 5/2006 | Iwasaki | F21S 41/147 362/545 |
| 2010/0110711 | A1 * | 5/2010 | Ookubo | F21S 41/147 362/514 |
| 2010/0165653 | A1 * | 7/2010 | Ookubo | F21V 13/02 362/539 |
| 2010/0226142 | A1 * | 9/2010 | Brendle | F21S 41/683 362/512 |
| 2011/0305033 | A1 * | 12/2011 | Sugiyama | B60Q 1/085 362/512 |
| 2012/0014125 | A1 * | 1/2012 | Uchida | F21S 41/162 362/538 |
| 2012/0039083 | A1 | 2/2012 | Meyrenaud | |

(Continued)

FOREIGN PATENT DOCUMENTS

| | | | |
|---|---|---|---|
| JP | 4459702 | B2 | 4/2010 |
| JP | 2012-524958 | A | 10/2012 |

*Primary Examiner* — Robert J May
*Assistant Examiner* — Leah Simone Macchiarolo
(74) *Attorney, Agent, or Firm* — Kenealy Vaidya LLP

(57) ABSTRACT

A vehicle lighting fixture can suppress the generation of uneven luminance regions. The vehicle lighting fixture can include two light sources arranged side by side on right and left sides, two reflecting portions configured to reflect light from the two light sources, respectively, and a shading portion configured to shield part of light reflected by the two reflecting portions. The shading portion includes left and right side portions inclined from its inside portion to its outside portion downward.

17 Claims, 11 Drawing Sheets

(56) References Cited

U.S. PATENT DOCUMENTS

| | | | | |
|---|---|---|---|---|
| 2014/0226355 | A1* | 8/2014 | Blandin | F21S 41/192<br>362/520 |
| 2015/0300588 | A1* | 10/2015 | Wang | F21S 48/1388<br>362/516 |
| 2018/0180247 | A1* | 6/2018 | Park | B60Q 1/06 |

* cited by examiner

VEHICLE LIGHTING FIXTURE

This application claims the priority benefit under 35 U.S.C. § 119 of Japanese Patent Application No. 2015-060584 filed on Mar. 24, 2015, which is hereby incorporated in its entirety by reference.

TECHNICAL FIELD

The presently disclosed subject matter relates to a vehicle lighting fixture.

BACKGROUND ART

Conventionally known lighting fixtures include a projector type headlight including a light source, a reflector configured to reflect light from the light source, and a projector lens configured to project the light reflected by the reflector forward. Examples of such a projector type headlight may include those disclosed in Japanese Patent No. 4459702 and Japanese Translation of PCT Patent Application Publication No. 2012-524958 (or US2012/039083A1 corresponding thereto).

The vehicle lighting fixture disclosed e former publication can include two light source units 30A and 30B disposed behind a projector lens 22 to be bilaterally symmetric in a left-right direction. The light source unit 30A can include a light emitting element 24A and a reflector 26A, and the light source unit 30B can include a light emitting element 24B and a reflector 26B. Here, the reflectors 26A and 26B are integrally formed. With this configuration, the light emitted from the respective light emitting elements 24A and 24B can be reflected by the corresponding reflectors 26A and 26B to secure a sufficient amount of light to be projected. (See, for example, paragraphs 0035 to 0038, 0055 to 0056, and 0062, and FIGS. 2 and 6(a) of Japanese Patent No. 4459702.)

The vehicle lighting fixture disclosed in the latter publication can include two light sources 5 and 6, two reflectors 2 having two reflecting surfaces 2*a* and 2*b* integrally formed to achieve a low-beam illumination function. (See, for example, paragraphs 0047 and 0059 to 0060, and FIGS. 1, 4, and 5 of Japanese Translation of PCT Patent Application Publication No. 2012-524958.) The vehicle lighting fixture in the latter publication can further include a lower lighting unit including alight source 7 and a second reflector 3 below the reflector 2 to also achieve a high-beam illumination function. (See, for example, paragraphs 0048 and 0061 to 0062, and FIGS. 2, 4, and 5.)

The hide lighting units of these publications are configured to include a light source and a reflector by one-to-one correspondence, and these publications have no mention about the technology in which the light from a first one of the light sources can be reflected to a second one of the reflector that does correspond to the first light source. Furthermore, it is uncertain how the light from the light sources can be effectively utilized. The resulting light distribution pattern would have illumination unevenness.

In consideration of these points in association with the conventional vehicle lighting fixtures, the present inventors conducted a trial production of a vehicle lighting fixture 100 illustrated in FIG. 1. The vehicle lighting fixture 100 was configured to include two light sources and reflect light from one of the light sources by a noncorresponding reflector out of reflectors.

Specifically, the vehicle lighting unit 100 of FIG. 1 can include the two light sources 110 and 120, two reflectors 130 (not shown) and 140, a projector lens 150 disposed in front of the reflectors 130 (not shown) and 140, and a shade 160 disposed below the reflectors 130 (not shown) and 140 for shielding the light reflected by the reflectors 130 (not shown) and 140 to control the light distribution. FIG. 2 shows the shade 160 having a top surface 162 having been subjected to aluminum vapor deposition. As a result, the top surface 162 can have an aluminum deposited film formed thereon to serve as a mirror-finished reflecting surface.

Note that in FIG. 1 the reflector 130 configured to cover the light source 110 is omitted for facilitating the understanding the internal structure and only the reflector 140 configured to cover the light source 120 is illustrated as a representative.

In this configuration, when the light sources 110 and 120 are turned on, the light emitted from the light sources 110 and 120 can be incident on the corresponding reflectors 130 (not shown) and 140 and reflected by the same forward basically, then enter the projector lens 150 to be projected forward and slightly downward. As a result of such a light distribution, the light from the light sources 110 and 120 can form a light distribution pattern illustrated in the drawing (a) of FIG. 3 having a bright-dark border at its upper end edge. In this case, however, the light distribution pattern illustrated in the drawing (a) of FIG. 3 is formed to include uneven luminance regions 200 and 202 on left and right sides.

In order to identify the cause of the uneven luminance regions 200 and 202, when only the light source 110 was turned on, a light distribution pattern as illustrated in the drawing (b) of FIG. 3 was formed. The light distribution pattern illustrated in the drawing (b) of FIG. 3 includes a remarkable uneven luminance region 204, and it was considered that the uneven luminance region 204 caused the uneven luminance region 200.

The inventors further examined the test results and found that when only the one light source 110 was turned on, the light from the light source 110 could also be incident on and reflected by the noncorresponding reflector 140 as the inventors had assumed, and then, part of the reflected light could be incident on the projector lens 150 but another part of the reflected light could be incident on a side portion 164 of the shade 160 and then further reflected as shown in FIG. 1. As a result, the light flux including these parts could be projected through the projector lens 150. The projected light could form a light distribution pattern as illustrated in the drawing (c) of FIG. 3. Note that the light distribution pattern illustrated in the drawing (c) of FIG. 3 is drawn by the light intensity magnified a hundred times to understand the light distribution pattern more clearly.

As can be seen from the drawing (c) of FIG. 3, the light is locally concentrated near the uneven luminance region 204. Then, the inventors focused attention on the shape of the shade 160 and found that the side portions 164 and 166 were, as can be seen from FIG. 2, configured to be flat as same as the center portion 163 of the top surface 162 and this configuration might be a cause for generating the uneven luminance region 204, and in turn, the uneven luminance regions 200 and 202.

SUMMARY

The presently disclosed subject matter was devised in view of these and other problems and features in association with the conventional art. According to an aspect of the presently disclosed subject matter, a vehicle lighting fixture can suppress the generation of uneven luminance regions.

According to another aspect of the presently disclosed subject matter, a vehicle lighting fixture can include: two light sources arranged side by side on right and left sides;

two reflecting portions configured to reflect light from the two light sources, respectively; and a shading portion configured to shield part of light reflected by the two reflecting portions, the shading portion including left and right side portions inclined from its inside portion to its outside portion downward. Here, the vehicle lighting fixture of the above-mentioned aspect can be configured such that the inclined left and right side portions can face to the respective corresponding reflecting portions. In this case, the left and right side portions and the corresponding reflecting portions can be configured such that when light from one of the light sources is incident on a noncorresponding one of the reflecting portions, the light can be repeatedly reflected between the noncorresponding reflecting portion and the side portion corresponding to the noncorresponding reflecting portion so as to be widely diffused.

According to still another aspect, the vehicle lighting fixture of any of the above-mentioned aspects can be configured to further include a rotating mechanism configured to rotate the shade so that a front portion of the shade vertically moves. In this case, when the rotating mechanism rotates the shade so that the front portion of the shade moves upward, the vehicle lighting fixture can form a low-beam light distribution pattern, and when the rotating mechanism rotates the shade so that the front portion of the shade moves downward, the vehicle lighting fixture can form a high-beam light distribution pattern.

With the abovementioned configuration made in accordance with principles of the presently disclosed subject matter, the side portions of the shading portion can be formed to incline from inside to outside downward so as to face to the respective corresponding reflecting portions. Thus, even when light from one of the light sources is incident on one of the reflecting portions that does not correspond to the light source, the light can be reflected repeatedly between the reflecting surface of the reflecting portion and the side portion of the shading portion to be diffused gradually and at last be incident on the projector lens. In this manner, the light that may cause the generation of the uneven illumination region can be diffused widely, thereby suppressing the generation of the uneven illumination region.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to a vehicle lighting fixture of the presently disclosed subject matter with reference to the accompanying drawings in accordance with exemplary embodiments.

The wording of "front (forward)," "rear (back, rearward)," "left," "right," "up (upward)," and "down (low, downward)" used herein is meant to represents the directions when the vehicle lighting fixture is installed on a vehicle body and a driver seating in the vehicle body observes the installed vehicle lighting fixture, unless otherwise specified.

The vehicle lighting fixture made in accordance with the principles of the presently disclosed subject matter can be a projector type headlight configured to form a low-beam light distribution pattern and a high-beam light distribution pattern in front of the vehicle body.

Figure 4:
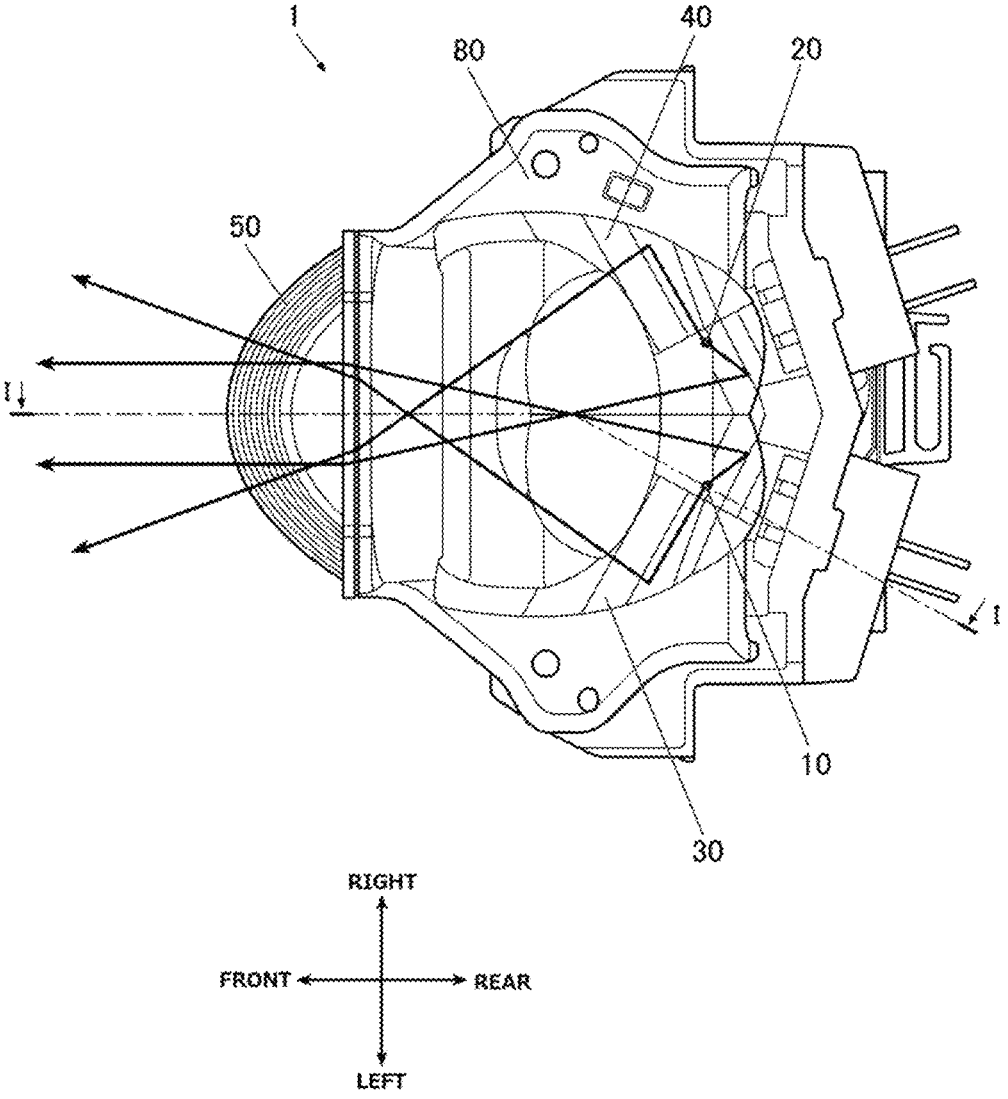
FIG. 4 is a plan view illustrating a schematic configuration of a vehicle lighting fixture made in accordance with principles of the presently disclosed subject matter.
Figure 5:
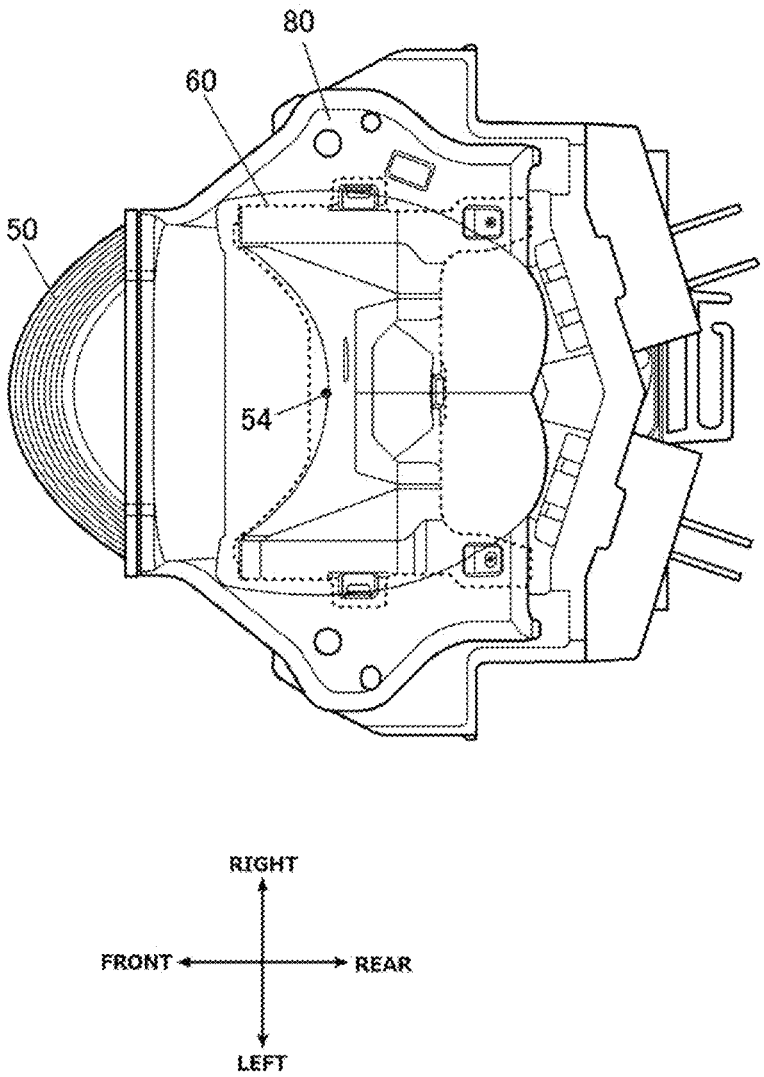
FIG. 5 is a plan view illustrating the schematic configuration of the vehicle lighting fixture when seeing through a reflecting portion.

As illustrated in FIGS. 4 and 5, the vehicle lighting fixture 1 can include two light sources 10 and 20, two reflectors 30 and 40, a projector lens 50, a shade 60, and a holder 80 configured to hold these components in position. The vehicle lighting fixture 1 can further include a rotating mechanism 70 below the shade 60 to rotate the shade 60.

Figure 9:
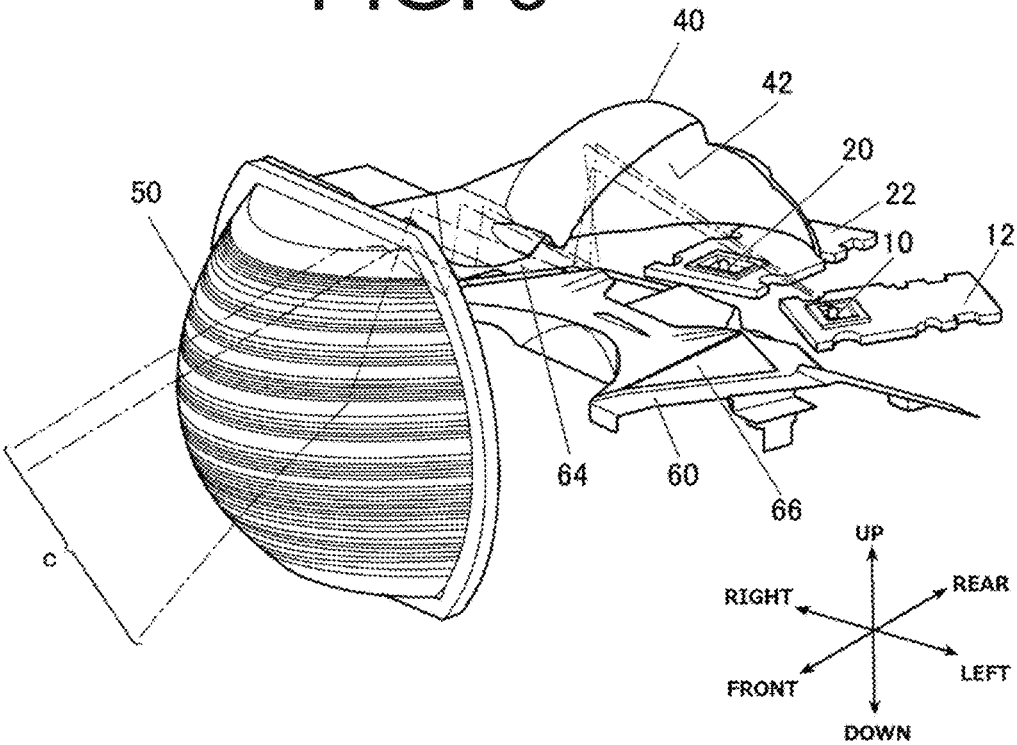
FIG. 9 is a perspective view of the vehicle lighting fixture for schematically illustrating loci of light rays in the case where one of the light sources is turned on and the noncorresponding reflector reflects light from that light source, the projected light rays forming a low-beam light distribution pattern.

Each of the two light sources 10 and 20 can be configured by a light emitting diode (LED), but it is not restrictive. Other light sources generally used as a vehicle headlight may be adopted. The two light sources 10 and 20 can be disposed to be bilaterally symmetric on respective supporting members 12 and 22 while facing upward so that respective emission faces thereof face upward as illustrated in FIG. 9. The two supporting members 12 and 22 can be held by the holder 80.

The two reflectors 30 and 40 can also be disposed to be bilaterally symmetric in the same manner as the light sources 10 and 20 and held by the holder 80.

The reflector 30 can be a resin-made reflecting member configured to mainly reflect light from the light source 10 and to be disposed to cover the upper side of the light source 10.

Figure 6A:
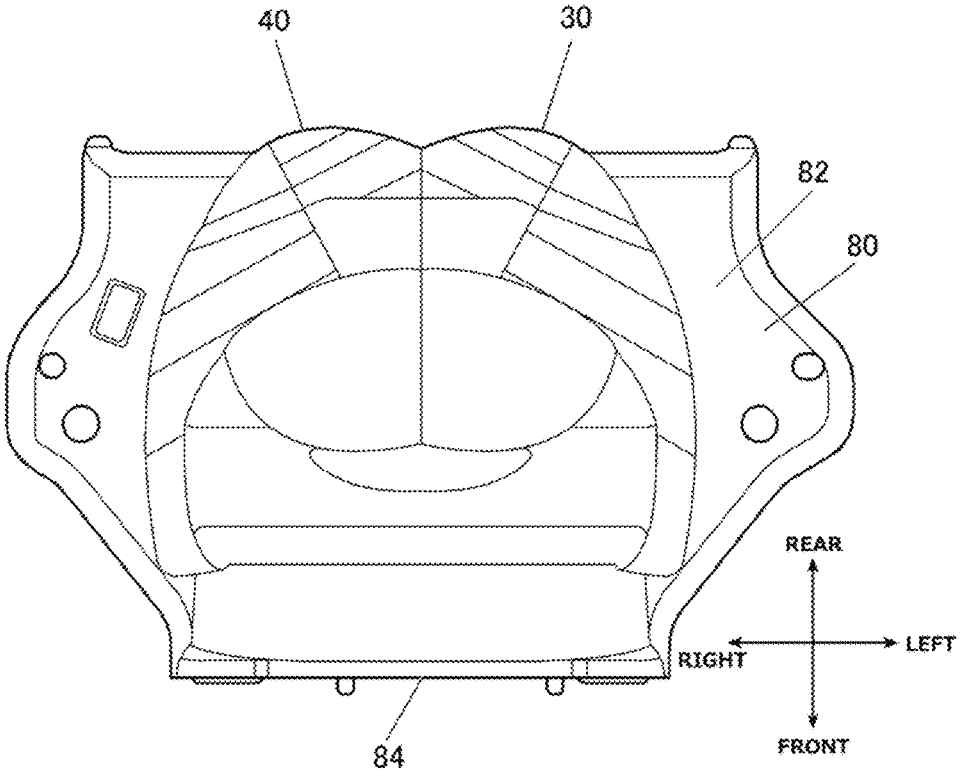
FIG. 6A is a plan view illustrating a schematic configuration of a holder including the reflecting portion.
Figure 6B:
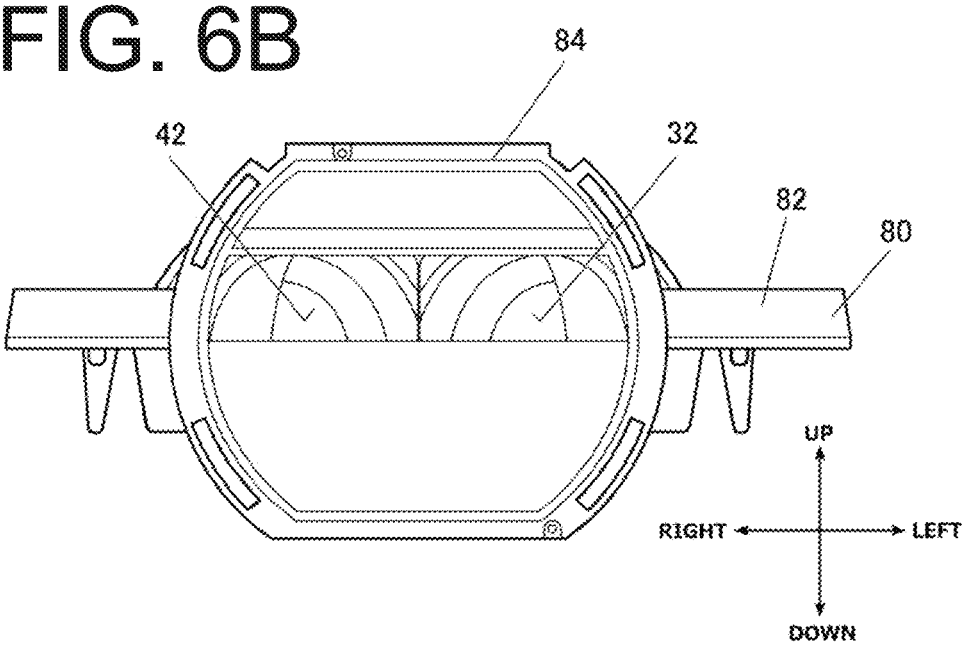
FIG. 6B is a front view of the holder when observed from its front side.

Specifically, as illustrated in FIG. 6A, the reflector 30 can be formed to have a curved plate shape opened forward and obliquely downward. As illustrated in FIG. 6B, the reflector 30 can include a reflecting face 32 on an inner face of the opened area thereof (lower face) which has been subjected to aluminum vapor deposition.

The reflector 40 can be a resin-made reflecting member configured to mainly reflect light from the light source 20 and to be disposed to cover the upper side of the light source 20.

Specifically, as illustrated in FIG. 6A, the reflector 40 can be formed to have a curved plate shape opened forward and obliquely downward. As illustrated in FIG. 6B, the reflector 40 can include a reflecting face 42 on an inner face of the opened area thereof (lower face) which has been subjected to aluminum vapor deposition.

The reflectors 30 and 40 can be integrally formed, and thus the reflecting faces 32 and 42 can also be integrally and continuously formed on the inner face of the opened area.

Each of the reflecting faces 32 and 42 can be formed to be a free-curved face based on a spheroid face having a first focal point at or near the corresponding light source 10 or 20 and a second focal point in front of the first focal point. Here, the reflecting faces 32 and 42 can have respective axes of rotation (axes of symmetry) that intersect each other so that the second focal points of the reflectors 32 and 42 are located to be coincident with the intersection of the axes of rotation.

Figure 8:
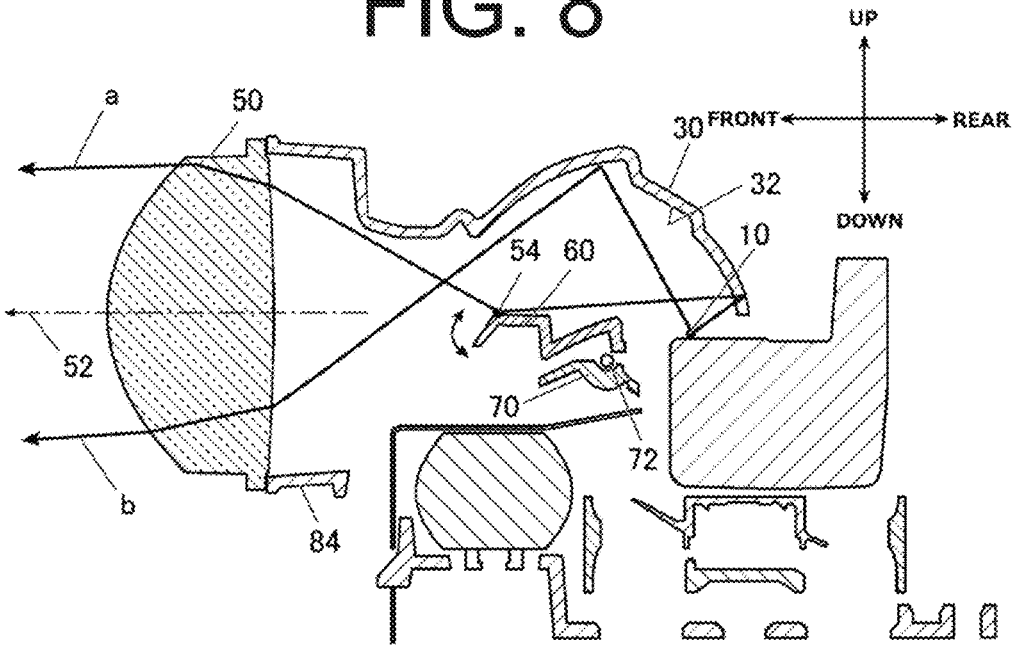
FIG. 8 is a cross-sectional view of the vehicle lighting fixture taken along line I-I of FIG. 4.

As illustrated in FIGS. 4, 5, and 8, the projector lens 50 can be an aspheric convex lens having an optical axis 52 along a front-rear direction and disposed in front of the reflectors 30 and 40. The projector lens 50 can have a focal point 54 disposed at or near the second focal points of the reflectors 32 and 42. The projector lens 50 can be configured to invert and project images of the light sources formed on a virtual plane at the focal points including its focal point 54 therethrough forward while widening the images in the left-right direction.

The shade 60 can be a light-shielding member configured to shield part of light rays reflected by the reflecting faces 32 and 42 of the reflectors 30 and 40 so as to form a bright-dark boundary line (cut-off line) at an upper end of a low-beam light distribution pattern. The shade 60 can be detachably held by the holder 80.

Figure 7A:
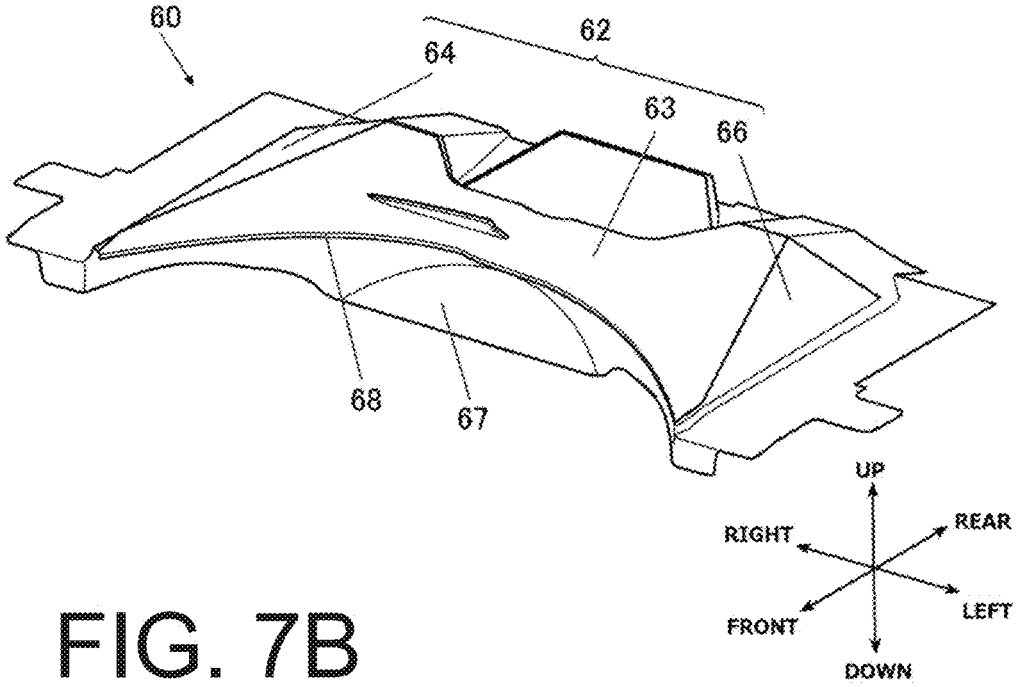
FIG. 7A is a perspective view illustrating a schematic configuration of a shading portion in a case where a low-beam (passing-by) light distribution pattern is to be formed.
Figure 7B:
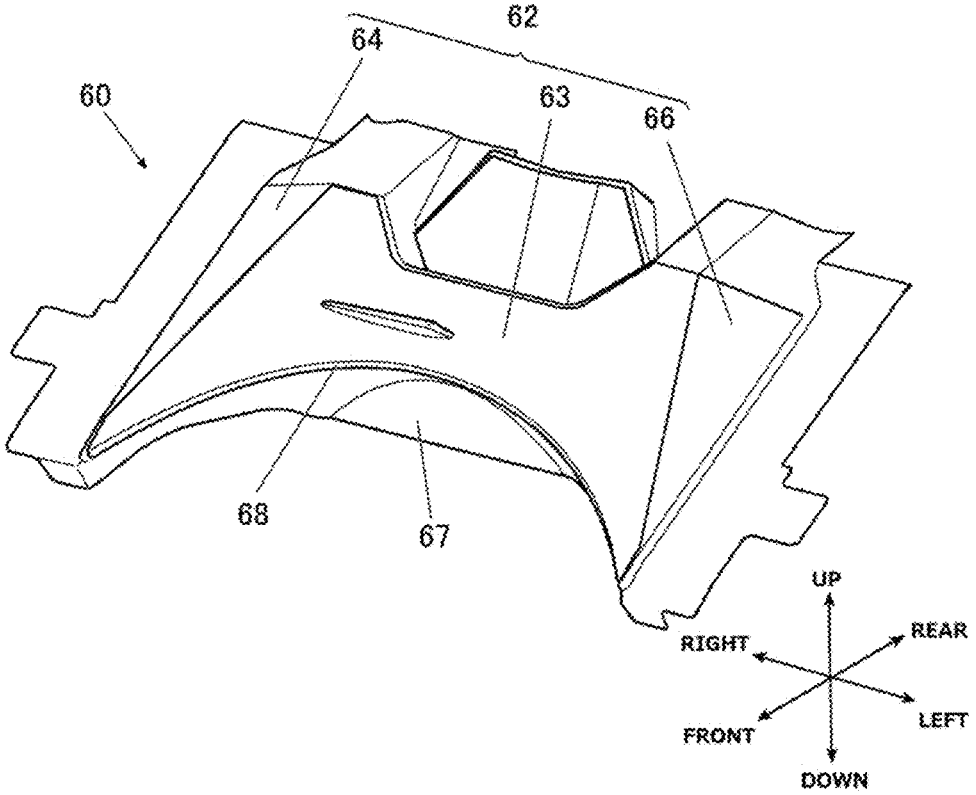
FIG. 7B is a perspective view illustrating the schematic configuration of the shading portion in a case where a high-beam (travelling) light distribution pattern is to be formed.

As illustrated in FIGS. 7A and 7B, the shade 60 can have a top surface 62 constituted by a center portion 63 and right and left side portions 64 and 66. The center portion 63 can have a letter H shape in a plan view while the side portions 64 and 66 can have a triangular shape symmetric to each other in a plan view.

The top surface 62 of the shade 60 can be subjected to aluminum vapor deposition to be mirror-finished. The top surface 62 can serve as a reflecting surface configured to reflect part of light reflected by the reflecting faces 32 and 42 to the projector lens 50.

The center portion 63 of the shade 60 can be a flat surface while the side portions 64 and 66 can be inclined from its inside portion to its outside portion downward. Here, an angle formed between the side portion 64, 66 and the reflecting face 32, 42 can be set smaller than an angle formed between a virtual extension line from the flat center portion 63 and the reflecting face 32, 42.

The shade 60 an have a front portion 67 curved rearward (recessed) to open forward and having an upper edge portion 68 substantially coincident with the focal points of the reflecting faces 32 and 42, meaning that the upper edge portion 68 can be positioned at or near the second focal points.

As illustrated in FIG. 8, the rotating mechanism 70 below the shade 60 can be configured to rotate the shade 60 around a rotary axis 72 so that the front portion 67 vertically moves. The rotating mechanism 70 can be supported by the holder 80.

FIG. 7A shows the state where the shade 60 is rotated to move the front portion 67 thereof upward while FIG. 7B shows the state where the shade 60 is rotated to move the front portion 67 thereof downward.

Figure 10:
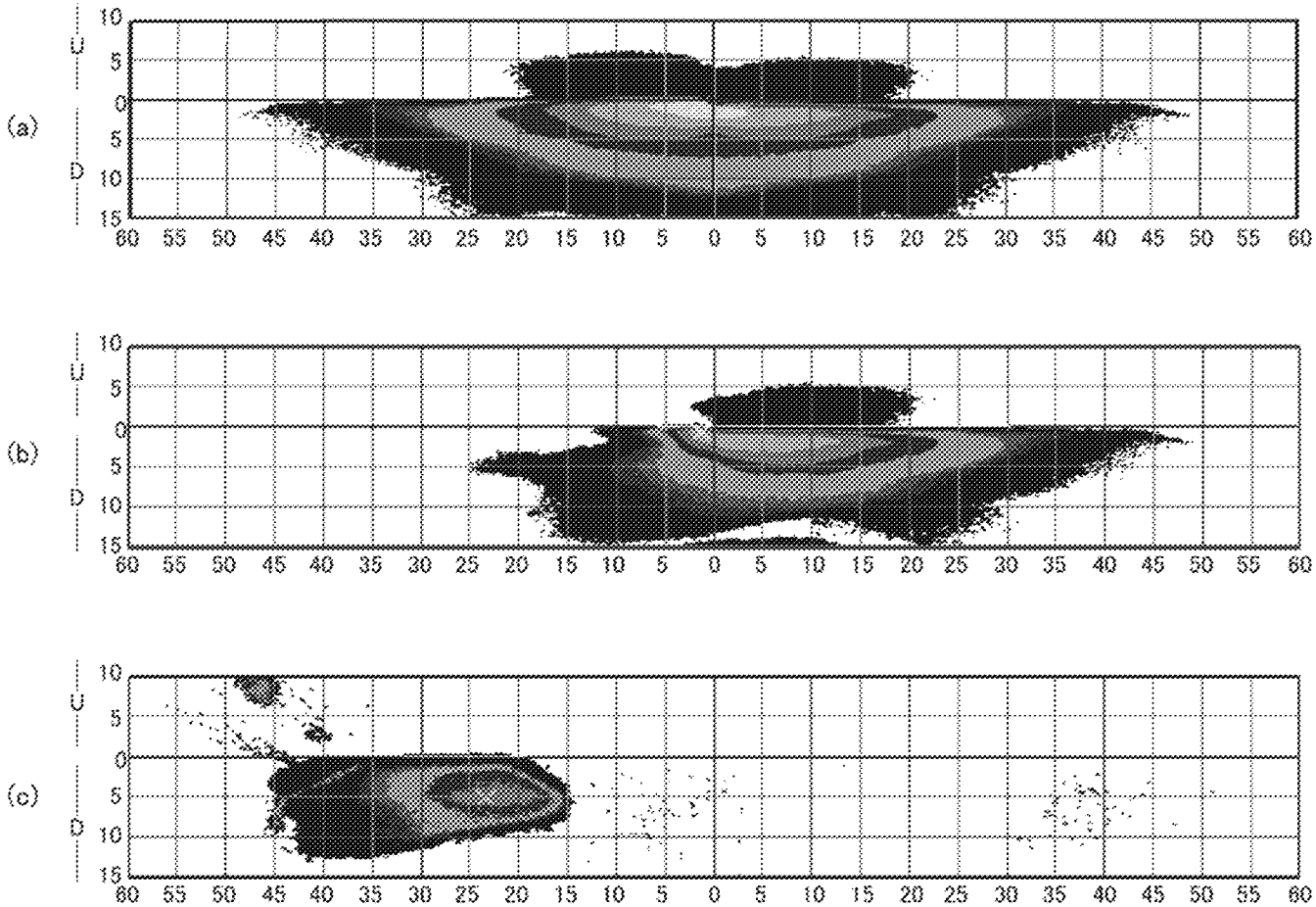
FIG. 10 includes diagrams for schematically explaining the low-beam light distribution pattern formed by the vehicle lighting fixture on a virtual screen assumed to be disposed in front of the vehicle lighting fixture, where the drawing (a) shows a case where both light sources are turned on, the drawing (b) shows a case where one of the light sources is turned on, and the drawing (c) shows a case where one of the light sources is turned on and a noncorresponding reflector reflects light from that light source and the illustrated pattern is formed by the light intensity magnified a hundred times to understand the light distribution pattern more clearly.
Figure 11:
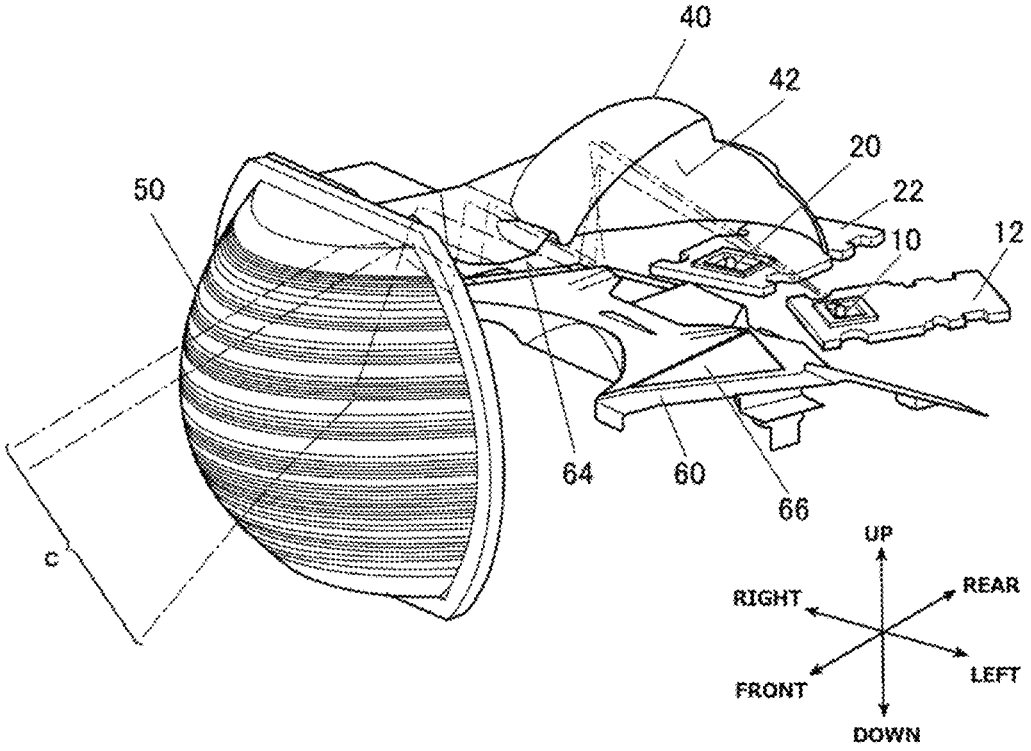
FIG. 11 is a perspective view of the vehicle lighting fixture for schematically illustrating loci of light rays in the case where one of the light sources is turned on and the noncorresponding reflector reflects light from that light source, the projected light rays forming a high-beam light distribution pattern.
Figure 12:
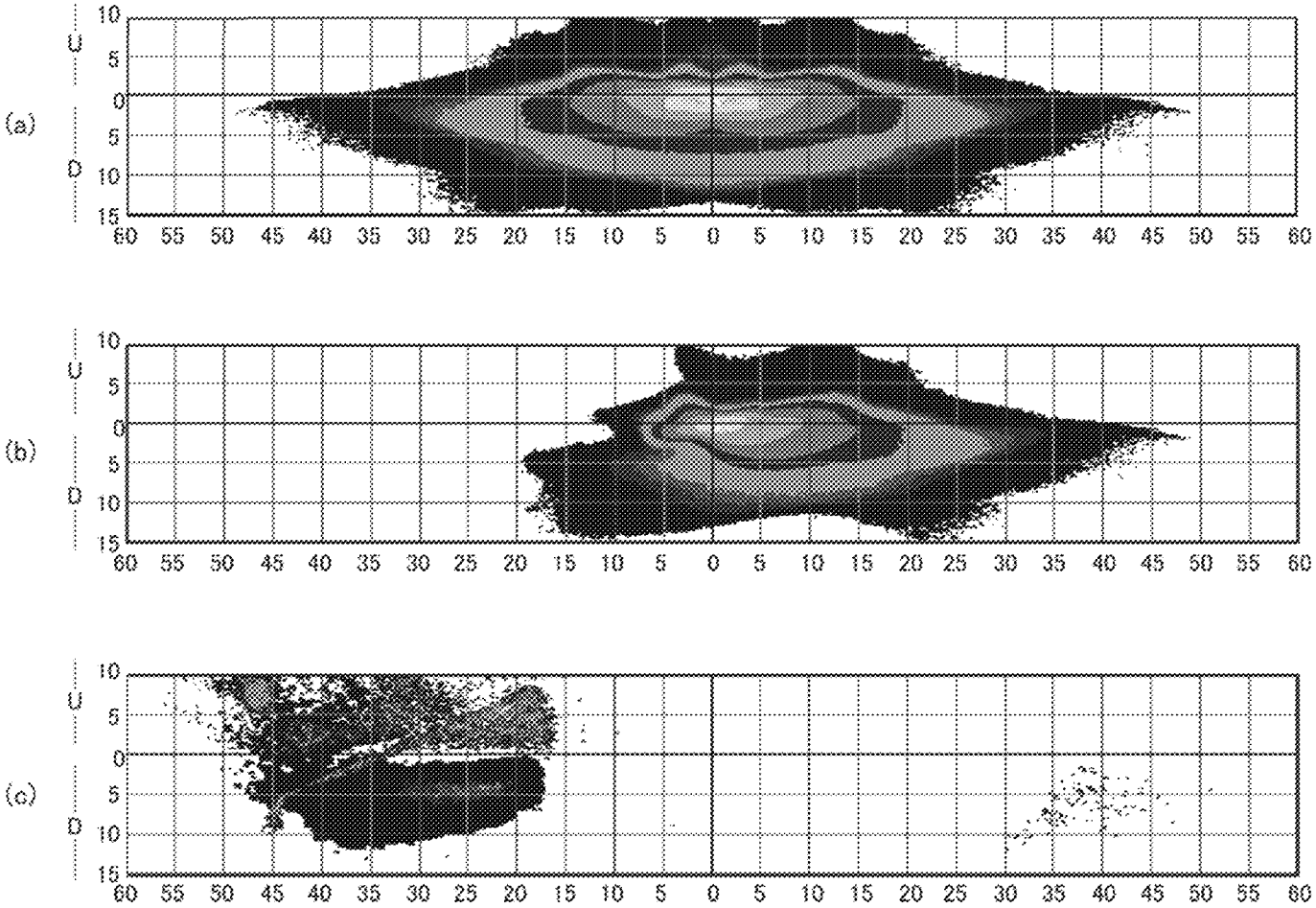
FIG. 12 includes diagrams for schematically explaining the high-beam light distribution pattern formed by the vehicle lighting fixture on a virtual screen assumed to be disposed in front of the vehicle lighting fixture, where the drawing (a) shows a case where both light sources are turned on, the drawing (b) shows a case where one of the light sources is turned on, and the drawing (c) shows a case where one of the light sources is turned on and a noncorresponding reflector reflects light from that light source and the illustrated pattern is formed by the light intensity magnified a hundred times to understand the light distribution pattern more clearly.

When the shade 60 is rotated to move the front portion 67 thereof upward, the vehicle lighting fixture 1 can form the low-beam light distribution pattern as illustrated in FIG. 10. When the shade 60 is rotated to move the front portion 67 thereof downward, the lighting fixture 1 can form the high-beam light distribution pattern as illustrated in FIG. 12.

The holder 80 can serve as a holding member made of a resin and configured to hold the respective components.

As illustrated in FIGS. 6A and 6B, the holder 80 can be configured to include a base portion 82 and a circular portion 84 connected to a front end of the base portion 82. The base portion 82 can support the light sources 10 and 20 via the respective supporting members 12 and 22, the reflectors 30 and 40, and the shade 60. The projector lens 50 can be fit to the peripheral portion of the circular portion 84 to be supported thereby.

A description will now be given of the light distribution patterns the vehicle lighting unit 1 can form.

First, a description will be given of how to form the low-beam light distribution.

When the light sources 10 and 20 are turned on while the shade 60 is rotated to move the front portion 67 thereof upward, the light rays emitted from the light sources 10 and 20 can be incident on the reflectors 30 and 40 to be reflected by the same forward. Then, the reflected light rays can enter the projector lens 50 to be projected forward and downward.

In order to facilitate the understanding, a description will be given of the case where only one light source 10 is turned on. In this case, the light rays from the light source 10 can mainly reach the reflector 30 to be reflected by the reflecting face 32 thereof.

In such a case, as illustrated in FIG. 8, part "a" of the light rays reflected by the reflecting face 32 can be reflected by the top surface 62 of the shade 60 upward and then enter the projector lens 50.

At the same time, another part "b" of the light rays reflected by the reflecting face 32 can pass over the shade 60 and then enter the projector lens 50.

On the other hand, as illustrated in FIG. 9, further another part "c" of the light rays from the light source 10 can reach the other noncorresponding reflector 40 and be repeatedly reflected by the reflecting face 42 and the side portion 64 of the shade 60, and then enter the projector lens 50.

Figure 1:
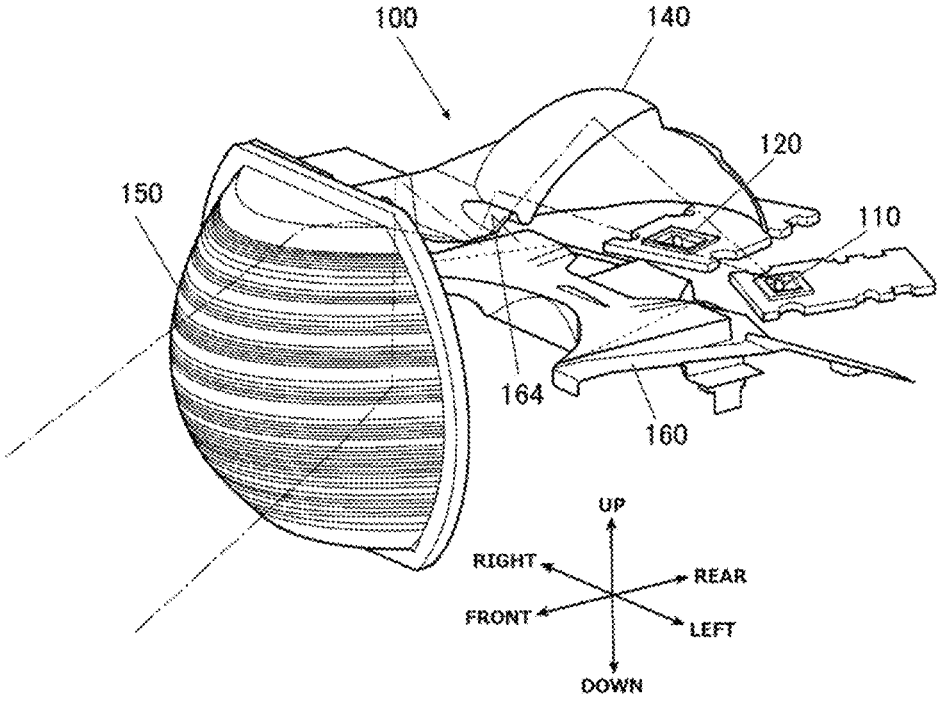
FIG. 1 Conventional Art
FIG. 1 is a perspective view illustrating a schematic configuration of a conventional vehicle lighting fixture.
Figure 2:
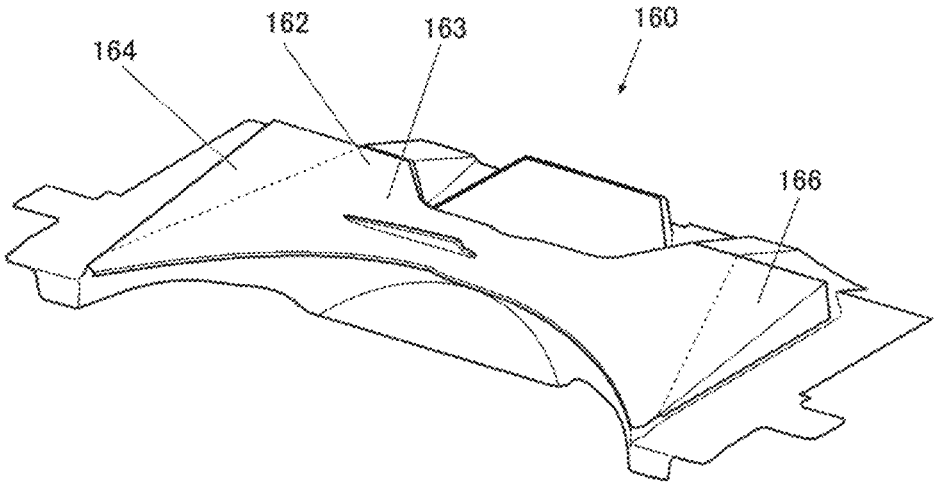
FIG. 2 Conventional Art
FIG. 2 is a perspective view illustrating a schematic configuration of a conventional shade.
Figure 3:
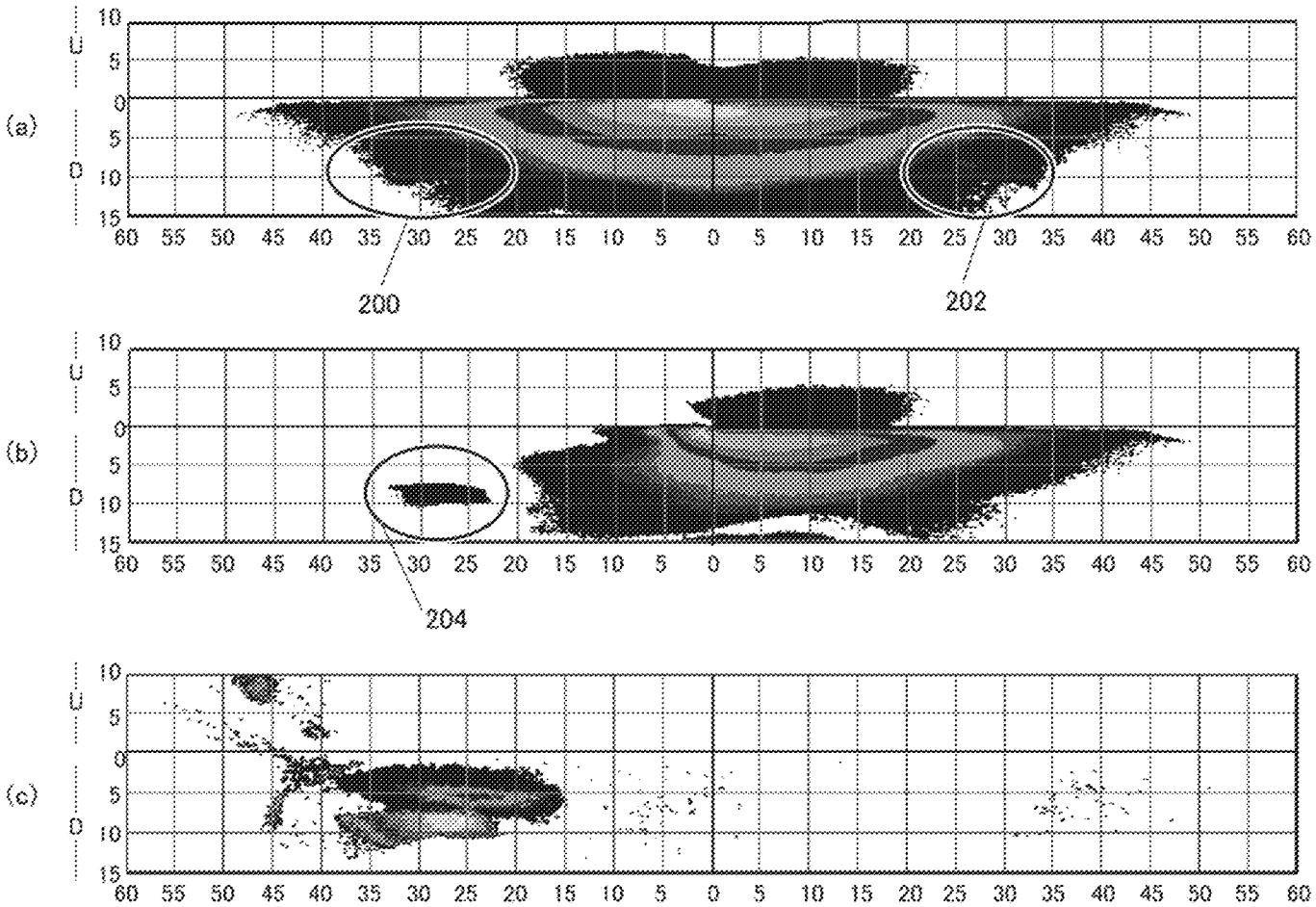
FIG. 3 Conventional Art
FIG. 3 includes diagrams for schematically explaining light distribution patterns formed by the vehicle lighting fixture of FIG. 1 on a virtual screen assumed to be disposed in front of the vehicle lighting fixture, where the drawing (a) shows a case where both light sources are turned on, the drawing (b) shows a case where one of the light sources is turned on, and the drawing (c) shows a case where one of the light sources is turned on and a noncorresponding reflector reflects light from that light source and the illustrated pattern is formed by the light intensity magnified a hundred times to understand the light distribution pattern more clearly.

As a result, the light rays from the light sources 10 and 20 can form the low-beam light distribution pattern shown in the drawing (a) of FIG. 10 having a bright-dark boundary line at its upper end. Here, the low-beam light distribution pattern shown in the drawing (a) of FIG. 10 does not have any uneven illumination region like the regions 200 and 202 in the drawing (a) of FIG. 3.

In the aforementioned case, only the light rays "a," "b," and "c" from the one light source 10 can form part of the low-beam light distribution pattern as illustrated in the drawing (b) of FIG. 10. As can be seen from the drawing (b) of FIG. 10, the part of the low-beam light distribution pattern does not have any uneven illumination region like the region 204 in the drawing (b) of FIG. 3. In particular, there is no uneven illumination caused by the light rays "c."

Specifically, the light rays "c" can form part of the low-beam light distribution pattern as illustrated in the drawing (c) of FIG. 10. The drawing (c) of FIG. 10 illustrates the pattern formed by the light intensity magnified a hundred times to understand the light distribution pattern more clearly. As can be seen from the drawing (c) of FIG. 10, the light rays are not locally concentrated unlike the drawing (c) of FIG. 3 near the uneven luminance region 204, but are widely diffused. Specifically, the light rays "c" can be repeatedly reflected by the reflecting face 42 and the side portion 64 to gradually widen the light flux of the dense light rays "c" so that the coarse light rays "c" can enter the projector lens 50. As a result, the light rays "c" can be reduced in the light intensity and form the part of the low-beam light distribution pattern with less effects on the formation of the desired low-beam light distribution pattern. Accordingly, the resulting low-beam light distribution pattern illustrated in the drawing (b) of FIG. 10 does not have any uneven illuminance region caused by the light rays "c."

Next, a description will be given of how to form the high-beam light distribution.

When the light sources 10 and 20 are turned on while the shade 60 is rotated to move the front portion 67 thereof downward, the light rays emitted from the light sources 10 and 20 can be incident on the reflectors 30 and 40 to be reflected by the same forward. Then, the reflected light rays can enter the projector lens 50 to be projected forward and downward.

Specifically, part "d" of the light rays emitted from the light source 10 and reaching the other reflector 40 can be repeatedly reflected by the reflecting face 42 and the side portion 64 of the shade 60, and then enter the projector lens 50.

As a result, the light rays from the light sources 10 and 20 can form the high-beam light distribution pattern shown in the drawing (a) of FIG. 12.

In the aforementioned case, only the light rays "a," "b," and "d" from the one light source 10 can form part of the high-beam light distribution pattern as illustrated in the drawing (b) of FIG. 12. As can be seen from the drawing (b) of FIG. 12, the part of the high-beam light distribution pattern does not have any uneven illumination region caused by the light rays "d."

Specifically, the light rays "d" can form part of the high-beam light distribution pattern as illustrated in the drawing (c) of FIG. 12. The drawing (c) of FIG. 12 illustrates the pattern formed by the light intensity magnified a hundred times to understand the light distribution pattern more clearly. As can be seen from the drawing (c) of FIG. 12, the light rays are widely diffused like the drawing (c) of FIG. 10. Specifically, also in this case, the light rays "d" can be repeatedly reflected by the reflecting face 42 and the side portion 64 to gradually widen the light flux of the dense light rays "d" so that the coarse light rays "d" can enter the projector lens 50. As a result, the light rays "d" can be reduced in the light intensity and form the part of the low-beam light distribution pattern with less effects on the formation of the desired high-beam light distribution pattern. Accordingly, the resulting high-beam light distribution pattern illustrated in the drawing (b) of FIG. 12 does not have any uneven illuminance region caused by the light rays "d."

As described above, according to the present exemplary embodiment, the side portions 64 and 66 of the shade 60 can be inclined from its inside portion to its outside portion downward so as to face to the respective corresponding reflecting faces 32 and 42. Therefore, when light rays from any (e.g. 10) of the light sources 10 and 20 reach the noncorresponding reflector 30 or 40 (e.g., 40), the light rays can be repeatedly reflected between the reflecting face 32 or 42 (e.g., 42) and the side portion 64 or 66 (e.g., 64) to gradually widen the light flux of the dense light rays so that the coarse light rays can enter the projector lens 50. As a result, the light that may cause the generation of uneven illuminance region can be y diffused thereby suppressing the generation of the uneven illumination region.

A modified example of the aforementioned exemplary embodiment will now be given.

The inclined angle of the side portions 64 and 66 of the shade 60 can be appropriately set to a range where the advantageous effects of the presently disclosed subject matter can be exerted.

The shape of the side portions 64 and 66 of the shade 60 can take other forms other than the triangular shape in a plan view, for example, polygonal shapes such as a rectangular shape. In this case, the side portion formed from a polygonal shape can have a plurality of faces sectioned by lines connecting their apexes. Further in this case, the inclined angle can be appropriately changed stepwisely face by face.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting fixture comprising:

two light sources arranged side by side on right and left sides;

two reflecting portions configured to reflect light from the two light sources, respectively; and a shading portion configured to shield part of light reflected by the two reflecting portions, the shading portion including a front portion and a top surface portion, the top surface portion including a flat center portion and left and right side portions inclined sideward from an inside portion thereof to an outside portion thereof downward, wherein each of the reflecting portions extends sideward and then forward to form a sideward portion configured to surround the shading portion, the front portion and the center portion thereof shield part of light reflected by the corresponding reflecting portions corresponding to the respective two light sources, and the inclined left and right side portions face to the corresponding sideward portions of the reflecting portions so that the left and right side portions diffuse the light reflected by noncorresponding reflecting portions to the two light sources.

2. The vehicle lighting fixture according to claim 1, further including a projector lens disposed in front of the two reflecting portions and the shading portion, and wherein the left and right side portions and the corresponding reflecting portions are configured to reflect light such that light from one of the light sources can be reflected between the noncorresponding reflecting portion and the side portion corresponding to the noncorresponding reflecting portion to exit through the projector lens.

3. The vehicle lighting fixture according to claim 2, further comprising a rotating mechanism configured to rotate the shade so that a front portion of the shade vertically moves.

4. The vehicle lighting fixture according to claim 3, wherein, when the rotating mechanism rotates the shade so that the front portion of the shade moves upward, the vehicle lighting fixture forms a low-beam light distribution pattern, and when the rotating mechanism rotates the shade so that the front portion of the shade moves downward, the vehicle lighting fixture forms a high-beam light distribution pattern.

5. The vehicle lighting fixture according to claim 2, wherein the two reflecting portions are integrally and continuously formed to be a free-curved face.

6. The vehicle lighting fixture according to claim 1, further comprising a rotating mechanism configured to rotate the shade so that a front portion of the shade vertically moves.

7. The vehicle lighting fixture according to claim 6, wherein, when the rotating mechanism rotates the shade so that the front portion of the shade moves upward, the vehicle lighting fixture forms a low-beam light distribution pattern, and when the rotating mechanism rotates the shade so that the front portion of the shade moves downward, the vehicle lighting fixture forms a high-beam light distribution pattern.

8. The vehicle lighting fixture according to claim 6, wherein the center portion and the left and right side portions of the top surface portion of the shading portion is subjected to a mirror-finishing to become reflecting surfaces.

9. The vehicle lighting fixture according to claim 8, wherein when the shading portion is rotated to move the front portion thereof downward, the reflecting surface of the left side portion of the shading portion is disposed at a position such that the light emitted from the light source on the right side and having been incident on the reflecting surface of the left side portion is repeatedly reflected between the reflecting face and the left side portion, and the reflecting surface of the right side portion of the shading portion is disposed at a position such that the light emitted from the light source on the left side and having been incident on the reflecting surface of the right side portion is repeatedly reflected between the reflecting face and the right side portion.

10. The vehicle lighting fixture according to claim 8, further comprising a projector lens disposed in front of the two reflecting portions and the shading portion, and wherein the left and right side portions and the corresponding reflecting portions are configured to reflect light such that light from one of the light sources can be reflected between the noncorresponding reflecting portion and the side portion corresponding to the noncorresponding reflecting portion to exit through the projector lens.

11. The vehicle lighting fixture according to claim 10, being capable of projecting light rays with a high-beam light distribution pattern when the two light sources are turned on while the shading portion is rotated to move the front portion thereof downward.

12. The vehicle lighting fixture according to claim 11, wherein when the shading portion is rotated to move the front portion thereof downward, the reflecting surface of the left side portion of the shading portion is disposed at a position such that the light emitted from the light source on the right side and having been incident on the reflecting surface of the left side portion is repeatedly reflected between the reflecting face and the left side portion, and the reflecting surface of the right side portion of the shading portion is disposed at a position such that the light emitted from the light source on the left side and having been incident on the reflecting surface of the right side portion is repeatedly reflected between the reflecting face and the right side portion.

13. The vehicle lighting fixture according to claim 10, wherein when the shading portion is rotated to move the front portion thereof downward, the reflecting surface of the left side portion of the shading portion is disposed at a position such that the light emitted from the light source on the right side and having been incident on the reflecting surface of the left side portion is repeatedly reflected between the reflecting face and the left side portion, and the reflecting surface of the right side portion of the shading portion is disposed at a position such that the light emitted from the light source on the left side and having been incident on the reflecting surface of the right side portion is repeatedly reflected between the reflecting face and the right side portion.

14. The vehicle lighting fixture according to claim 6, wherein the two reflecting portions are integrally and continuously formed to be a free-curved face.

15. The vehicle lighting fixture according to claim 1, wherein the center portion and the left and right side portions of the top surface portion of the shading portion is subjected to a mirror-finishing to become reflecting surfaces.

16. The vehicle lighting fixture according to claim 1, wherein an angle formed between each of the left and right side portions of the shading portion and a reflecting face of the corresponding one of the reflecting portions is set smaller than an angle formed between a virtual extension line from the center portion and the reflecting face.

17. The vehicle lighting fixture according to claim 1, wherein the two reflecting portions are integrally and continuously formed to be a free-curved face.

* * * * *